United States Patent [19]

Labarile

[11] Patent Number: 4,598,495

[45] Date of Patent: Jul. 8, 1986

[54] SECURITY ENCLOSURE FOR A DOOR FRAME

[75] Inventor: Paul Labarile, Pittsburg, Calif.

[73] Assignee: Campbell Design Group, Inc., Pacheco, Calif.

[21] Appl. No.: 642,145

[22] Filed: Aug. 20, 1984

[51] Int. Cl.[4] ..... E06B 3/90; E05C 19/10

[52] U.S. Cl. ..... 49/41; 49/35; 49/42; 49/68

[58] Field of Search ..... 49/68, 67, 40, 41, 42, 49/49, 35, 141; 109/7, 68; 307/353

[56] References Cited

U.S. PATENT DOCUMENTS

| | | | |
|---|---|---|---|
| 617,308 | 1/1899 | Cobb | 49/42 |
| 931,502 | 8/1909 | Schureman | 49/40 |
| 1,632,683 | 6/1927 | Tracy | 109/7 |
| 1,686,831 | 10/1928 | Matchette | 49/68 |
| 1,905,547 | 4/1933 | Wood | 49/68 |
| 1,960,578 | 5/1934 | Earl | 109/7 |
| 2,076,765 | 4/1937 | Eldred | 109/7 |
| 2,348,900 | 5/1944 | Hagenbook | 49/35 |
| 3,045,615 | 7/1962 | Atchison | 49/40 |
| 3,602,536 | 8/1971 | Gamble | 49/68 |
| 3,955,322 | 5/1976 | Call, Jr. | 49/68 |
| 4,282,689 | 8/1981 | Royer | 49/67 |
| 4,302,689 | 11/1981 | Brodie | 307/35 |
| 4,341,165 | 7/1982 | Calandritti et al. | 49/42 |

FOREIGN PATENT DOCUMENTS

| | | | |
|---|---|---|---|
| 1467369 | 3/1977 | United Kingdom | 49/41 |

*Primary Examiner*—Victor N. Sakran
*Attorney, Agent, or Firm*—Bielen & Peterson

[57] ABSTRACT

A security enclosure for use with an existing door frame which is within a wall having first and second sides and extending upwardly from a base. A first door is hingedly connected to the door frame and includes a second portion which is capable of latching to the door frame. Between the first and second portions is a third portion which extends outwardly from the door and includes a ceiling. A second door of like construction is placed on the second side of the wall within the door frame to form a security unit.

15 Claims, 9 Drawing Figures

SECURITY ENCLOSURE FOR A DOOR FRAME

BACKGROUND OF THE INVENTION

The present invention relates to a novel security enclosure which may be used with an existing door frame.

Certain areas within a building or compound require security. In this regard, persons entering and leaving the security area must be controlled. Often security areas are designated to exist in standing edifices which are not originally designed as security spaces.

Second doors such as those shown in U.S. Pat. Nos. 617,308 and 4,302,689 have been designed to reduce heat loss from a building by forming a small chamber outside the door of the building. U.S. Pat. Nos. 1,960,578 and 2,076,765 describe protective doors which forms small enclosures for security reasons. U.S. Pat. No. 3,955,322 describes a single entry lock which may be swung from one side of a door frame to another. None of the prior art devices shows a security door which may be used in conjunction with a conventional door frame which has emergency opening features.

SUMMARY OF THE INVENTION

In accordance with the present invention a novel and useful security enclosure for a door frame is provided.

The security enclosure is designed to fit in a door frame within a wall having first and second sides and spaces adjacent to the sides. The wall extends upwardly from a base.

A first door having a first portion hingedly connects to the door frame. The second portion of the first door is capable of being positioned immediately adjacent the door frame. An intermediate third portion connected to the first and second portions of the door lies away from the door frame when the second portion of the first door positions next to the door frame. The third portion also includes a ceiling which may also be fixed to the door or to the first side of the wall. Thus, a first chamber is formed in relation to the base or ground. First chamber extends outwardly from the first side of the wall.

A second door similar in construction to the first door may also be divided for hinged connection to the door frame. The second door would form a second chamber which extends outwardly from second side of the wall. The first and second chambers by the first and second doors would interconnect to form a chamber unit. The chamber unit would be capable of holding at least one person therewithin.

Means may be provided for permitting the second portion of the first door to travel to the space on the second side of the wall. Since the second door already is capable of swinging away from the second side of the wall, this feature may function to permit the first and second doors to serve as an emergency exit.

The security enclosure may be constructed such that means is included for latching the second portions of the first and second doors to the existing door frame. Such latching means has an element which lies within the chamber unit or doorway. Means may also be provided for removing the latching means element from the doorway when the first and second doors are used as an emergency exit. Thus, latching means would not serve as a hindrance to opening the first and second doors in an emergency situation. This may be accomplished by attaching the latching means element to a plate. The plate, in turn, would be attached to a hinge which would pivot from the inside of the doorway to the space adjacent the second side of the wall.

The latching means element may be locked into the chamber unit during normal use of the security enclosure. Such latching means may include a shaft which is spring biased toward the latching means element plate. A pivot having a first and second arm is also employed such that the first arm of the pivot is connected to the shaft and the second arm of the pivot is connected to a pin. The pin is capable of fitting into an opening in the latching means element of a plate and may be positioned obliquely in relation thereto. In this embodiment, the plate would be prevented from accidently swinging from its position within the chamber unit. Means may also be provided for holding and releasing the spring biased shaft from its position where the pin is within the opening in the latching means plate. Such means may take the form of a panic bar which may pressed resulting in the pin being released from the plate. At this point, the first door traveling from the first side of the wall to the second door would force the latching means element from the doorway.

It may be apparent that a novel and useful security enclosure for a door frame has been described.

It is an object of the present invention to provide a security enclosure for a door frame which may be adapted to structures which have not been specifically designed as security enclosures.

It is another object of the present invention to provide a security enclosure for a door frame which obviates the necessity for constructing a second emergency door adjacent the door frame.

It is yet another object of the present invention to provide a security enclosure for a door frame which is compatible with user identification apparatusses which are normally remotely operated.

It is yet another object of the present invention to provide a security enclosure for a door frame which is relatively simple and inexpensive to manufacture and install.

The invention possesses other objects and advantages especially as concerns particular characteristics and features thereof which will become apparent as the specifications continues.

Figure 1:
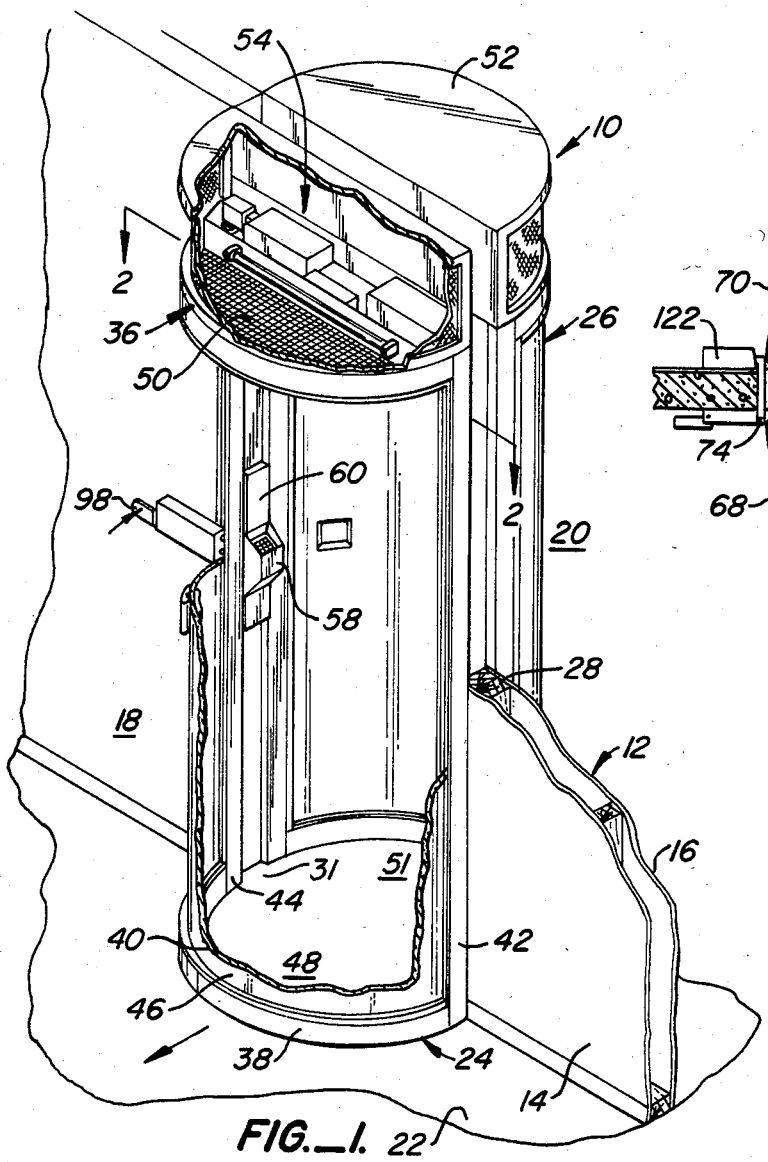
FIG. 1 is the top perspective view of the security enclosure of the present invention.

For a better understanding of the invention reference is made to the following detailed description of the preferred embodiments thereof which should be taken in conjunction with the hereinabove described drawings.

DESCRIPTION OF THE PREFERRED EMBODIMENTS

Various aspects of the present invention will evolve from the detailed description of the preferred embodiments thereof which should be taken in conjunction with the hereinabove described drawings.

The invention as a whole is represented in the drawings by reference character 10. The security enclosure 10 is intended to be used in conjunction with a wall 12 having first side 14 and second side 16 which define spaces 18 and 20 adjacent thereto. Wall 12 extends upwardly from a base 22 which may be a ground surface, a floor, and the like.

A first door 24 and a second door 26 are attached to jamb 28 of door frame 30. Door frame 30 may be of a conventional configuration found in existing buildings and other structures. First door 24 swings on a pivot pen 32 while second door does the same on pivot pen 34. Pivot pins 32 and 34 may extend the height of doors 24 and 26, or be formed into pairs with one pin extending into base 22 and the other pin extending into overhead structure 36, which is itself connected to door frame 30, FIGS. 1 and 2. First and second doors 24 and 26 are substantially identical in structure except that one door is the mirror image of the other door. Therefore, the description following for first door 24 applies to second door 26 in this manner. First door 24 includes a metal frame 38 and a clear curved section 40 therebetween. Curved section 40 may be constructed of glass, plastic, or other materials suitable for security doors. Metal frame 24 includes a first portion 42 which is hingedly connected to the door frame 30. A second portion 44 is capable of being positioned immediately adjacent to door frame opposite the hinged connection heretofore described. Third portion 46 of first door 24 extends away from door frame 30 and forms a first chamber 48 in conjunction with base 22 and ceiling 50 of overhead structure 36. First chamber 48 extends outwardly from first side 14 of wall 12. Second door 26 hingedly attached to jamb 28 of door frame 30 forms a second chamber 51 which extends second side 16 of wall 12. Overhead structure 36 may be connected to first door 24 and move with the swing of door 24. Likewise second door 26 and overhead structure 52 may possess the same abilities. As shown in the drawings, overhead structures 36 and 52 are connected to door frame 30 which, is contiguous with wall 12. In any case, overhead structures 36 and 52 would be supported directly or indirectly from door frame 30.

Overhead structures 36 and 52 may include certain components 54 such as lighting fixtures, video equipment, and the like, which may be associated with a security enclosure. As may be apparent, the base of overhead structures 36 and 52 form the ceilings 50 and another (not shown) for chambers 48 and 51 respectively. Chambers 48 and 51 combine into a chamber unit 56, FIG. 2, which is large enough for only one person. This feature prevents more than one person from entering chamber unit 56, the so called "tailgating" maneuver, which would thwart the access restriction capability of security enclosure 10.

Figure 2:
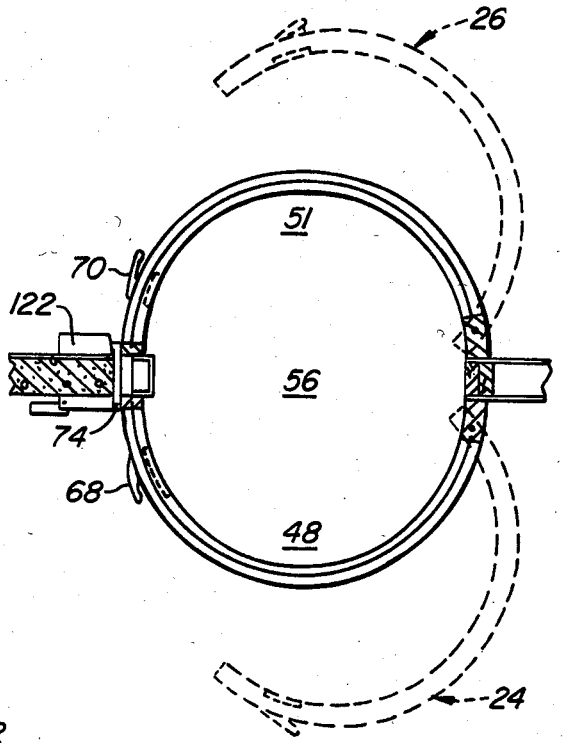
FIG. 2 is a view taken along line 2—2 of FIG. 1.
Figure 3A:
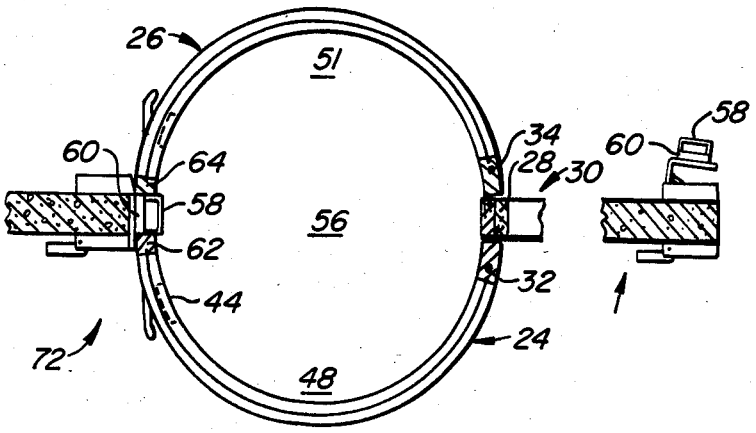
FIGS. 3A and 3B are views similar to FIG. 2 showing the sequence of movement of the first and second doors when being used as an emergency exit.

With reference to FIGS. 1 and 3A it may be seen that certain components of the security systems are shown schematically. For example, identification security console 58 and magnetic locks 60 which are found within the confines of door frame 30. Doors 24 and 26 include metal portions 62 and 64 at the ends of the second portions. Means 66 is provided for permitting second portion 44 of first door 24 to travel from first side 14 to second side 16 of wall 12, FIG. 3B. Console 58 and magnetic lock 60 are shown to have pivoted from the doorway area 31 within door frame 30, which will be described hereinafter. It should be noted that first and second doors 24 and 26 include handles 68 and 70 for opening the same in the normal manner as depicted in FIG. 2.

Figure 3B:
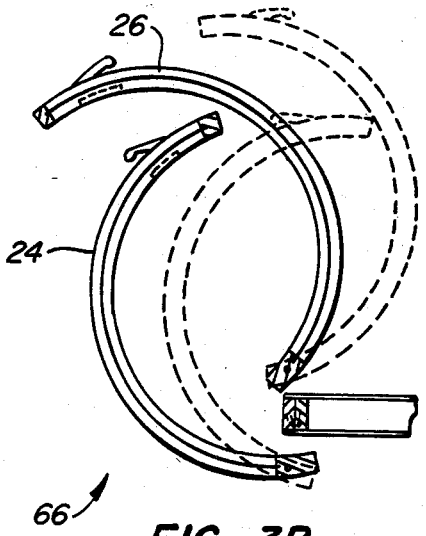
Figure 4:
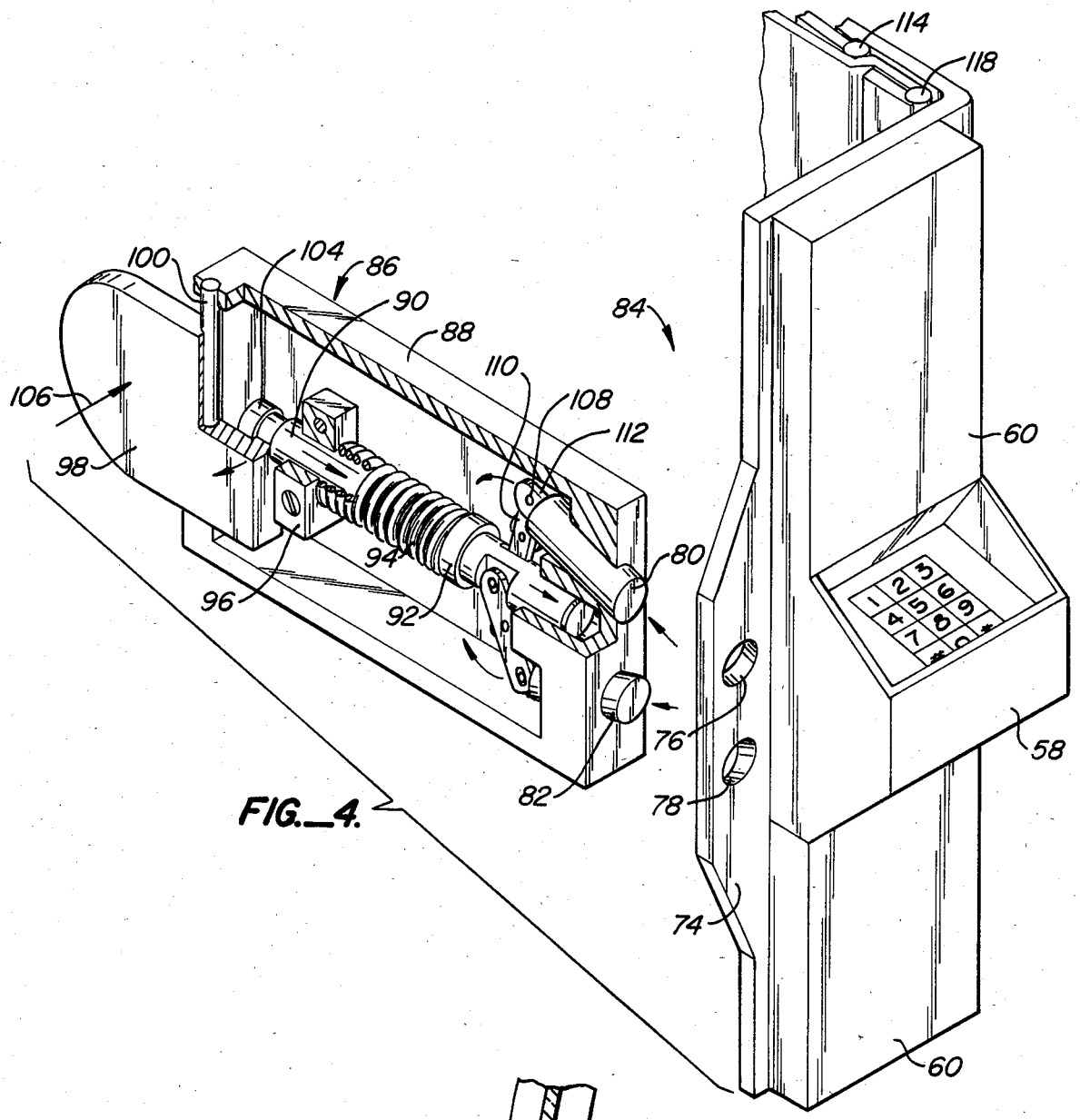
FIG. 4 is an exploded perspective of the latching mechanism of the present invention.
Figure 5A:
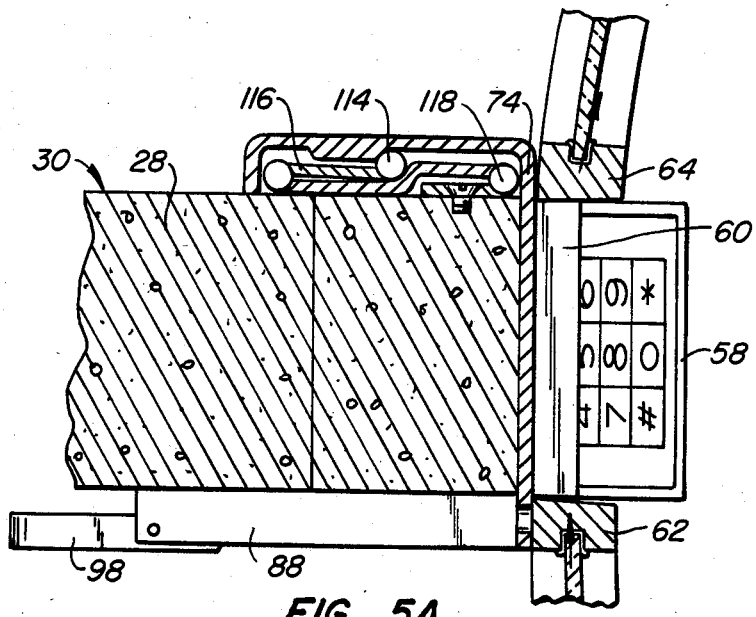
FIG. 5A is a sectional view showing the hinge mechanism associated with the latching means of the present invention.
Figure 5B:
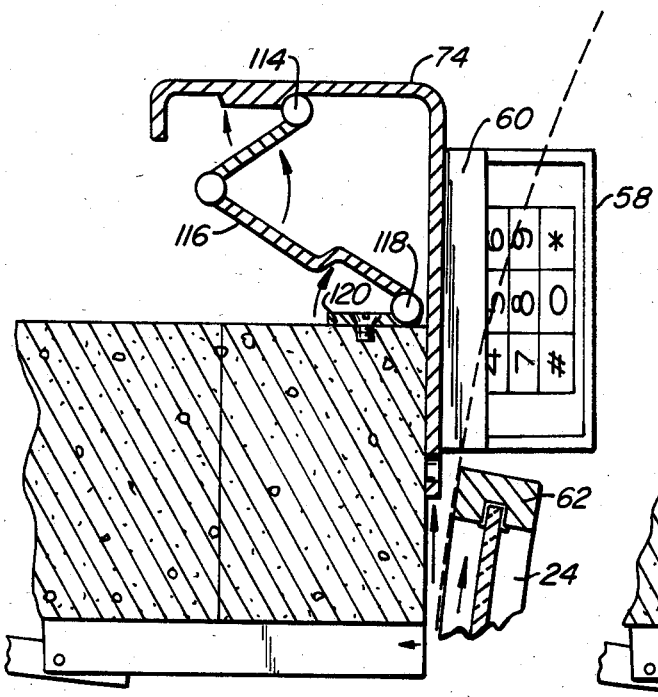
FIGS. 5B–D represent a view similar to FIG. 5A showing the sequence of movement of the latching means element from the chamber unit.
Figure 5C:
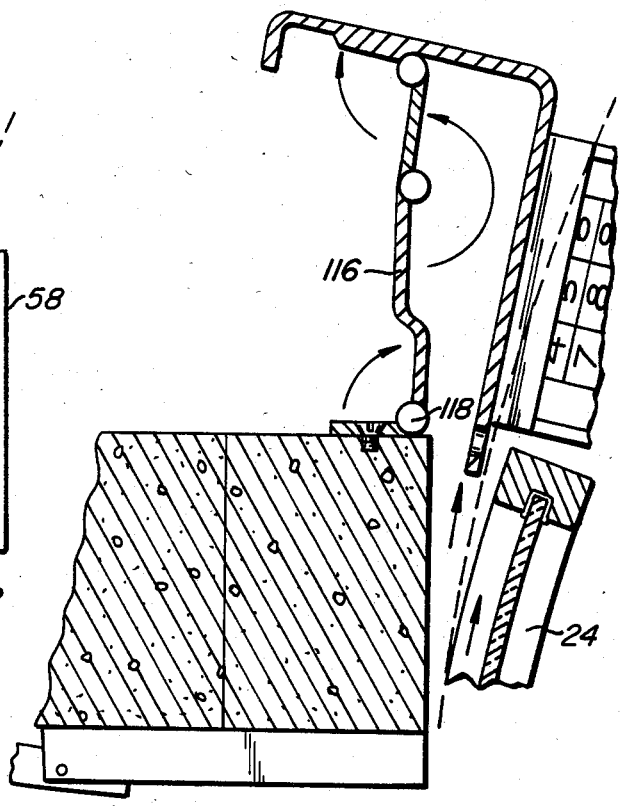
Figure 5D:
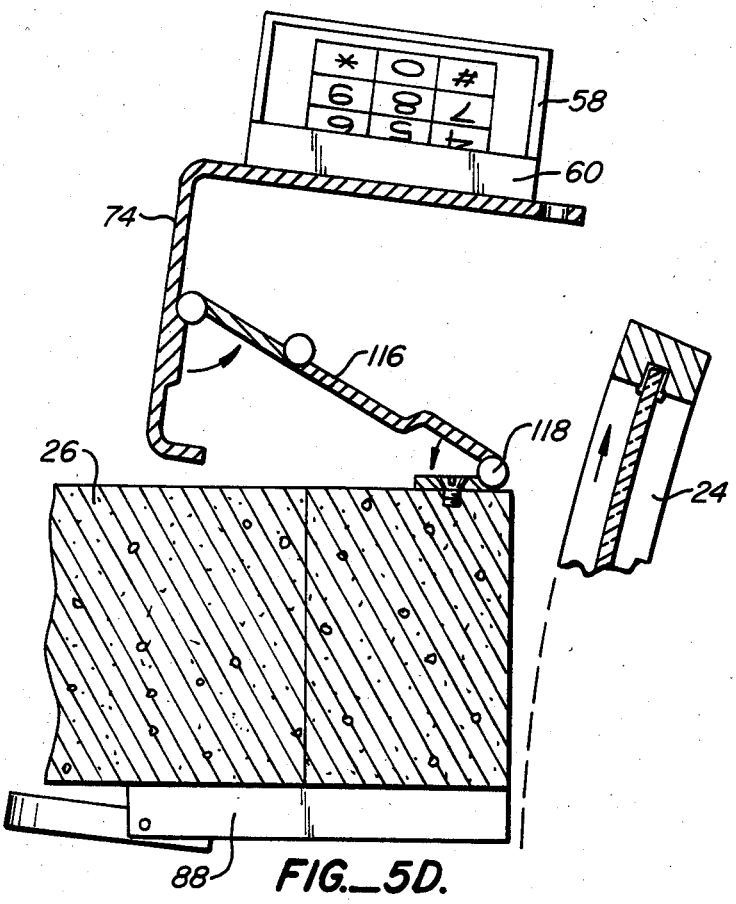

As heretofore described, magnetic lock 60 shown schematically in FIGS. 2, 3A–3B, serves as means 72 for latching the second portions of first and second doors 24 and 26 to the door frame 30. Means 72 may include an element 74 which may take the form of an L-shaped plate. Element 74 includes openings 76 and 78 for accepting slanted pins 80 and 82, FIG. 4. Magnetic lock 60 and security console 58 are fastened to element 74 for movement therewith. Means 84 for removing plate 74 from within the door frame 30 (doorway 31) is also shown the present invention. As illustrated in FIG. 4, means 84 operates in conjunction with means 86 for locking latching means 72. Means 86 includes a housing 88 which encompasses a locking mechanism therewithin. Shaft 90 includes a collar 92 at one end and a journal 96 generally at the other end of the shaft 90. A coil spring 94 is found between the collar 92 and journal 96 and serves to bias shaft 90 from plate 74. A panic bar 98 which pivots on pin 100 includes a hook 102 which catches collar 104 on the end of shaft 90. Thus, shaft 90 is prevented from movement toward the plate 74 by the panic bar 98. In this position pins 80 and 82 extend through the end of housing 88 and pass through openings 76 and 78 of plate 74. It should be noted that FIG. 4 is an exploded view in this regard. Pushing panic bar 98 as shown by directional arrow 106 permits shaft 90 to travel toward plate 74 and pins 80 and 82 to retract from opening 76 and 78 of plate 74. This action releases plate 74. Pins 80 and 82 operate in the same manner in that pin 80 include a pivot 108 having a first arm 110 connected to shaft 90. A second arm 112 moving about pivot 108 connects to pin 80. The remaining directional arrows shown in FIG. 4 depict the movement of component portions of means 86 in the releasing mode.

With references to FIGS. 5A–5D, the mechanism for removing plate 74 and the attached components from within the door frame 30 (shown schematically in FIGS. 3A and 3B) is depicted in detail. Plate 74 includes a pivot pin 114 which is connected to pivoting hinge 116. Pivoting hinge 116 in turn rotates on pivot pin 118. Plate 120 is fastened to jamb 28. Door 24 is free to move from first side 14 of wall 12 to second side 16 of wall 12 and into space 20. In essence, security enclosure 10 also serves as an emergency exit.

FIG. 2 depicts a cardreader 122 which is vertically displaced from plate 74 on side 16 of wall 12. Cardreader 122 is depicted schematically in FIGS. 3A and 3B for the sake of simplicity.

The following is a list of components which are contemplated for use with the embodiment shown in the drawings:

| | |
|---|---|
| 1. Cardreader 122 | "Insertion reader" manufactured by Sensor Engineering Co. of Connecticut. |
| 2. Magnetic lock 60 | 254-4 manufactured by Locknetics of Bristol Connecticut |

-continued

| | |
|---|---|
| 3. Identifying lock console 58 | Model C-20 manufactured by Campbell Engineering Co., Pacheco, Ca. |

In operation, the user would travel from second side 16 to first side 14 of wall 12. An identification card would be inserted in cardreader 122 which would open second door 26. The user would enter chamber unit 56 and enter the proper code in lock console 58. If other identification type devices are employed in security enclosure 10 they would be operated at this time. Both doors 24 and 26 are locked in this mode. Upon clearance the user would travel through first door 24 which would open allowing the user to enter the secure space 18 on first side 14 of wall 12. In an emergency situation the user would press panic bar 98 which would permit plate 74 to be released. Lock console 58 and magnetic lock 60 would then be capable of traveling from within the door frame 30 to second space 20 on second side 16 of wall 12. Door 24 would capable of pushing plate 74 in this direction and swing from first side 14 of wall 12 to second side 16 of wall 12. As depicted in FIGS. 3A and 3B, persons may then swiftly exit space 18 through door frame 30.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A security enclosure for a door frame within a wall having first and second sides and spaced adjacent thereto and the wall extending upwardly from a base comprising:

a. a first door having a first portion hingedly connected to the door frame, a second portion capable of being positioned immediately adjacent the wall, and a third portion connected to said first and second portions and lying away from the door frame when said second portion of said first door positions immediately adjacent the door frame, said first, second and third portions of said first door forming a first chamber with the base, said first chamber extending outwardly from the first side of the wall;

b. a second door having a first portion hingedly connected to the door frame, a second portion capable of being positioned immediately adjacent the wall, and a third portion connected to said first and second portions and lying away from the door frame when said second portion of said second door positions immediately adjacent the door frame, said first, second, and third portions of said second door forming a second chamber with the base, said second chamber extending outwardly from the second side of the wall said first and second chambers interconnecting to form a chamber unit; and c. means for permitting said second portion of said first door to travel to the space on the second side of the wall a sufficient distance to form a gap between said second portion of said first door and the door frame, said gap permitting movement of persons from the first to the second side of the wall.

2. The security enclosure of claim 1 in which said first and second doors each including a ceiling supported by the wall, said ceiling lying adjacent said third portions of said first and second doors.

3. The security enclosure of claim 1 which additionally comprises means for latching said second portions of said first and second doors to the door frame.

4. The security enclosure of claim 3 in which said latching means includes an element which lies within the door frame.

5. The security enclosure of claim 4 which further comprises means for removing said latching means element lying within the door frame unit from within the door frame.

6. The security enclosure of claim 4 in which said means for removing said latching means element from within the door frame unit includes a plate affixed to said latching means element and a hinge attached to said latching means element and the second side of the wall, said latching means element pivoting on said hinge and moving from within the door frame to the space adjacent the second side of the wall. the wall.

7. The security enclosure of claim 6 in which said security enclosures additionally comprises means for locking said latching means element within the door frame.

8. The security enclosure of claim 7 in which said locking means includes a shaft and a spring biasing said shaft toward said latching means element, a pivot having a first arm and a second arm, said first arm of said pivot being connected to said shaft and said pivot, said second arm being connected to a pin, said pins being capable of fitting into an opening in said latching means element and means for holding said spring biased shaft under spring tension such that said pin fits within said opening of said latching means element.

9. The security enclosure of claim 7 which additionally comprises means for releasing said means for holding said spring biased shaft thus permitting said pin to leave said latching means element plate.

10. The security enclosure of claim 9 in which said pin is positioned obliquely in relation to said latching means element plate.

11. A security enclosure for a door frame within a wall having first and second sides and spaces adjacent thereto and the wall extending upwardly from a base comprising:

a. a first door having a first portion hingedly connected to the door frame and a second portion capable of being positioned immediately adjacent the wall and a third portion connected to said first and second portions and lying away from the door frame when said second portion of said first door positions immediately adjacent the door frame, said first, second and third portions of said first door forming a first chamber with the base, said first chamber extending outwardly from the first side of the wall;

b. a second door having a first portion hingedly connected to the door frame, a second portion capable of being positioned immediately adjacent the wall, and a third portion connected to said first and second portions and lying away from the door frame when said second portion of said second door positions immediately adjacent the door frame, said first, second, and third portions of said second door forming a second chamber with the base, said second chamber extending outwardly from the second side of the wall said first and second chambers interconnected to form a chamber unit;

c. means for latching said second portions of said first and second doors to the door frame; said latching means including an element lying within the door frame; and d. means for removing said latching means element lying within the door frame unit from within the door frame, said means for removing said latching means element from within the door frame unit including a plate affixed to said latching means element and a hinge attached to said latching means element and the second side of the wall, said latching means element pivoting on said hinge and moving from within the door frame to the space adjacent the second side of the wall.

12. The security enclosure of claim 11 in which said security enclosures additionally comprises means for locking said latching means element within the door frame.

13. The security enclosure of claim 12 in which said locking means includes a shaft and a spring biasing said shaft toward said latching means element, a pivot having a first arm and a second arm, said first arm of said pivot being connected to said shaft and said pivot, said second arm being connected to a pin, said pins being capable of fitting into an opening in said latching means element and means for holding said spring biased shaft under spring tension such that said pin fits within said opening of said latching means element.

14. The security enclosure of claim 12 which additionally comprises means for releasing said means for holding said spring biased shaft thus permitting said pin to leave said latching means element plate.

15. The security enclosure of claim 14 in which said pin is positioned obliquely in relation to said latching means element plate.

* * * * *